US007086569B2

(12) United States Patent
Stravitz

(10) Patent No.: US 7,086,569 B2
(45) Date of Patent: Aug. 8, 2006

(54) ALL-PURPOSE DISPENSER

(76) Inventor: David M. Stravitz, 16 Park Ave. - Suite 14A, New York, NY (US) 10016

( * ) Notice: Subject to any disclaimer, the term of this patent is extended or adjusted under 35 U.S.C. 154(b) by 121 days.

(21) Appl. No.: 10/751,377

(22) Filed: Jan. 5, 2004

(65) Prior Publication Data

US 2004/0140320 A1 Jul. 22, 2004

Related U.S. Application Data

(60) Provisional application No. 60/438,242, filed on Jan. 6, 2003.

(51) Int. Cl.
*B67D 3/38* (2006.01)

(52) U.S. Cl. ..... 222/157; 222/181.1; 222/185.1; 222/565; 220/908

(58) Field of Classification Search ..... 222/157, 222/181.1, 185.1, 345, 351, 482, 500, 565, 222/642; 220/908, 908.2
See application file for complete search history.

(56) References Cited

U.S. PATENT DOCUMENTS 401,313 A * 4/1889 Titus ..... 222/465.1
1,558,396 A * 10/1925 Roehrs ..... 222/564
2,495,806 A * 1/1950 Block ..... 222/548
2,610,432 A * 9/1952 Ambrose ..... 222/196.5
2,725,162 A * 11/1955 Roop ..... 222/565
4,437,575 A * 3/1984 Hahn ..... 220/87.1
5,031,799 A * 7/1991 Owen ..... 222/131
5,295,610 A * 3/1994 Levison ..... 222/26

* cited by examiner

*Primary Examiner*—Joseph A. Kaufman
(74) *Attorney, Agent, or Firm*—Frishauf, Holtz, Goodman & Chick, P.C.

(57) ABSTRACT

Dispenser including a cartridge module and a powder or liquid dispensing agent arranged in the cartridge module. Dispensing occurs when the dispenser is jarred which causes the dispensing agent to pass through one or more dispenser openings in a lower wall of the cartridge module. For example, when the dispenser is mounted to an inner surface of a pivotable lid of a waste disposal can, closure of the lid against a base of the can causes a jarring impact on the lid which results in an amount of the dispensing agent falling through the dispensing opening(s). The lid can also be manually tapped when closed to jar the dispenser.

32 Claims, 4 Drawing Sheets

ALL-PURPOSE DISPENSER

CROSS-REFERENCE TO RELATED APPLICATION

This application claims priority under 35 U.S.C. §119(e) of U.S. provisional patent application Ser. No. 60/438,242 filed Jan. 6, 2003.

FIELD OF THE INVENTION

The present invention relates generally to a dispenser of powder or liquid, and more particularly to a replaceable and/or a disposable cartridge module that functions in several areas, namely powder or liquid dispensing (baby and adult), deodorizing of used diapers and other disposables (including garbage), disinfectant of potentially harmful and ordinary substances (viral & bacterial contaminants) and finally, for use as an all-purpose soap cleanser dispenser.

The present invention also relates to a waste disposal can including a dispenser which dispenses a liquid or powder dispensing agent into the waste-receiving receptacle in the can.

BACKGROUND OF THE INVENTION

Pails for garbage, including diaper pails and the like, sometimes include a deodorizer attached to an underside of the lid of the pail. The deodorizer includes a housing containing a solid block of deodorant and defining air passages through which airborne particles of the deodorant are released into the entrance or interior of the pail.

A drawback of the use of a solid block of deodorant in such a pail is that the release of airborne particles is essentially unregulated, i.e., airborne particles are released from the deodorant irrespective of the insertion of new waste into the pail. Thus, the deodorant may be entirely used up with only a few insertions of waste spread out over a period of time.

OBJECTS AND SUMMARY OF THE INVENTION

Accordingly, it is an object of the present invention to provide a waste disposal container which enables a regulatable dispensing of a substance, in particular, dispensing of a substance upon closure of a lid of the waste disposal container or after insertion of a waste item into the waste disposal container.

It is another object of the present invention to provide an apparatus for use in connection with a waste disposal container which requires manual effort to dispenses a substance to counteract existing or potential effects of the garbage in the waste disposal container, e.g., counteract odors or infections which might be caused by the waste.

In order to achieve these objects and others, the invention is a self-contained dispenser including a cartridge module or capsule and a powder or liquid dispensing agent arranged in an interior of the cartridge module. The dispenser is designed to administer a pre-determined amount of the powder or liquid dispensing agent that is released by the effects of gravity and impact, either alone or in combination with one another. The amount of powder or liquid that is dispensed is regulated by either fixed or variable openings in the cartridge module, and is released by the motion of hand-tapping or the result of impact of one member against another, such as a lid closing on a base of a can, i.e., a waste disposal can with a hinged lid, or a closeable cover of a baby diaper and waste disposable pail.

One significant advantage of the present invention is to provide added protection against infestation and bacterial (common and hazardous) breeding in anything from home garbage cans to institutional applications such as that of garbage receptacles in doctors, surgeons, dentists, hospital, nursing homes and home bed care, to name just a few of the possible applications.

The cartridge module can be a small can (capsule) which can have a flange to allow it to slide-lock into a molded receptacle, or it may simply have a peel-off pressure sensitive adhesive thereon so as to be placed (stuck) in existing pails, etc.

As a powder dispenser (soap, baby powder, disinfectant, etc.) for use in non-disposal can applications, the dispenser can be placed into or onto a wall-mounted receptacle (holder) that will allow one to dispense a pre-allotted portion of powder (or soap, etc.) into their hand by either (1) tapping it with their hand, (2) incorporating it into a mechanical device that creates an impact that simulates the tap, or (3) a timed motion sensor that creates a minute impact for dispensing the powder after detecting motion (i.e., the presence of a hand). The last-mentioned device will allow hands-free operation so as to further minimize the possibilities of migratory infestation of bacteria in both public and private environments and applications. Such environments, to name a few, are hotels, hospitals, home use, airport bathrooms, airplanes, office bathrooms, and medical offices.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
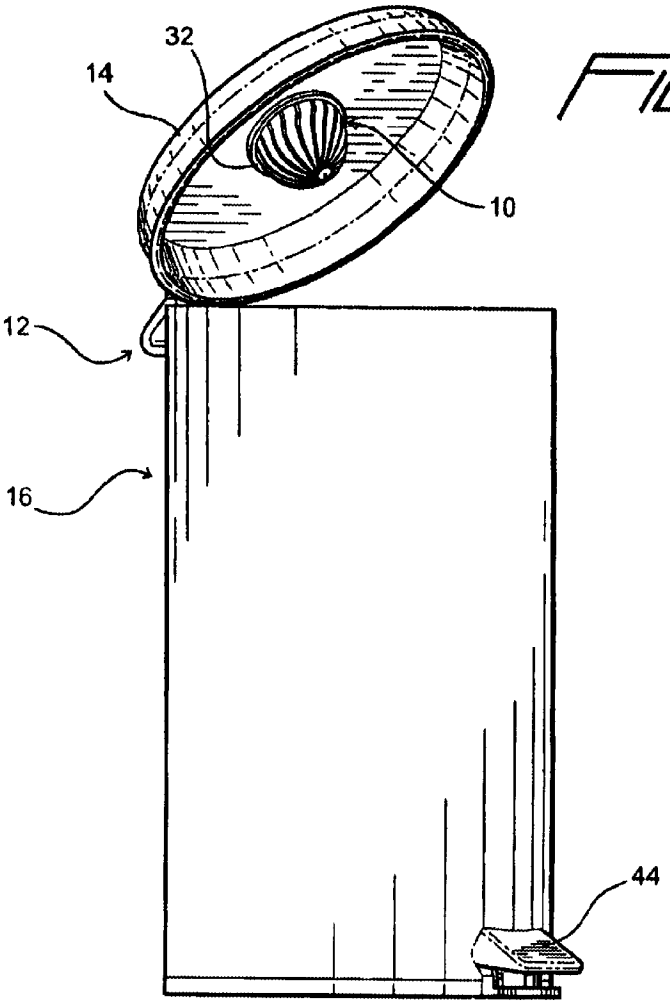
FIG. 1 is a view of a trash can (garbage pail) with a hinged lid and with a dispenser in accordance with the present invention mounted on an inner surface of the hinged lid.

Referring to the accompanying drawings, FIG. 1 shows a dispenser of the present invention, designated generally as 10, mounted on an inner surface of a pivotable lid 14 of a trash or diaper disposal can 12. Disposal can 12 may be any type of can or vessel which includes a base 16, which defines a waste-receiving receptacle adapted to accept and receive waste products, and a lid 14 movably mounted thereto to enable an opening to the receptacle in the base 16 to be opened for insertion of waste into the receptacle and closed to prevent the emission of odors from the waste in the receptacle. Disposal can 12 can take any number of different forms, shapes and sizes and be adapted for different types of waste, for example, it may be in the form of a Sharps can for medical waste. Thus, as used herein, the disposal can 12 is not limited to any one particular type or form of waste receptacle.

Dispenser 10 may be adhered to a horizontal, lower surface of the lid 14, for example, using an adhesive such as double-sided adhesive tape. Preferably, the adhesive is removable so that the dispenser 10 can be removed when the powder or liquid therein is exhausted, for replacement by a new dispenser. Such a new dispenser may come with double-sided adhesive tape on the upper surface thereof for easy adherence to the inner surface of the lid 14 of the disposal can 12.

Other ways to attach the dispenser 10 to the lid 14 include the use of Velcro(TM) on the dispenser 10 and the inner surface of the lid 14 or the construction of a slot on the inner surface of the lid 14 into which the dispenser 10 slides. Other cooperating attachment mechanisms can also be used in the invention.

The dispenser 10 is ideally placed on the inner surface of the lid 14 at a location which is opposite to the waste insertion opening, or a portion thereof, defined in the base 16 of the disposal can 12. If the base 16 has a waste insertion opening defined by the upper peripheral edge, then the dispenser 10 can be placed anywhere on the inner surface of the lid 14. On the other hand, if there is a garbage bag in the disposal can 12 which has a waste insertion opening only at a center region, e.g., such as a diaper pail using a twisting technique to encapsulate the diapers, then the dispenser 10 would optimally be placed in a center region of the inner surface of the lid 14 opposite this waste insertion opening.

Figure 4:
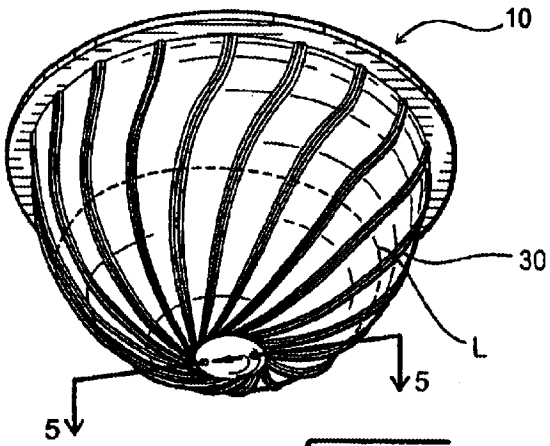
FIG. 4 is an enlarged view of a third embodiment of the dispenser in accordance with the invention.
Figure 2:
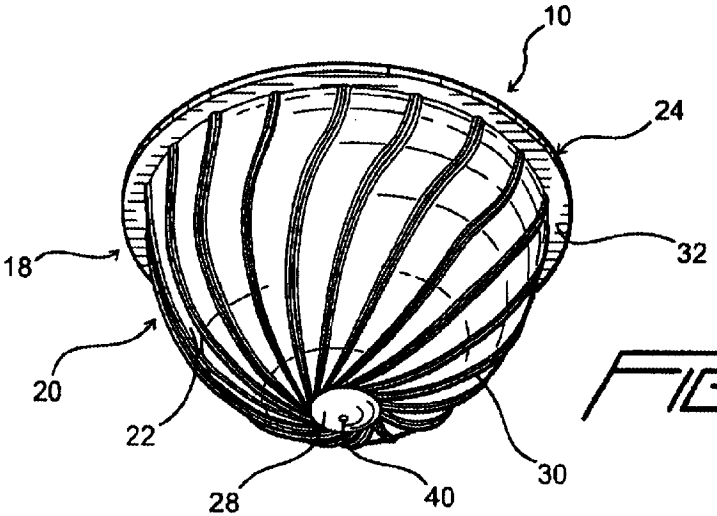
FIG. 2 is an enlarged view of a first embodiment of the dispenser in accordance with the invention.
Figure 3:
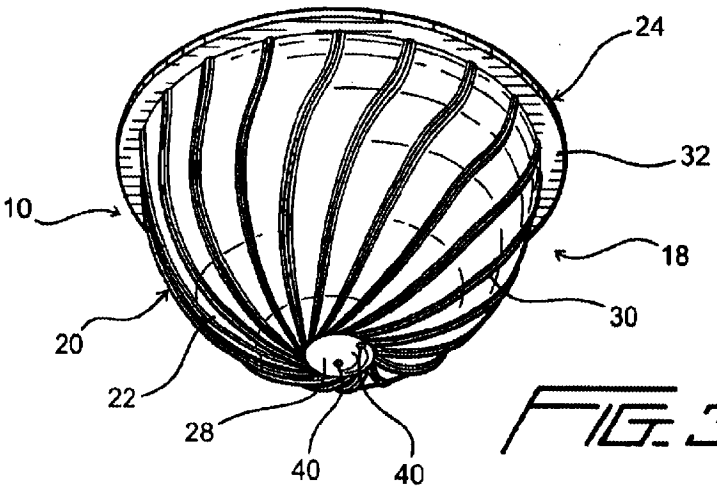
FIG. 3 is an enlarged view of a second embodiment of the dispenser in accordance with the invention.

FIGS. 2–4 show various embodiments of the dispenser 10 in greater detail. Generally, the dispenser 10 comprises a unitary, approximately hemispherical-shaped cartridge module 18 having an approximately hemispherical or bowl-shaped portion 20 defined by one or more side walls 22 and an upper cover portion 24 defined by a substantially planar upper wall 26. The bowl-shaped portion 20 also includes a lower wall 28 at a bottom thereof. The bowl-shaped portion 20 also includes an optional reinforcing structure, e.g., a spiral pattern of ridges 30. When present, the spiral pattern of ridges 30 extend from a circumferential, outwardly extending flange or lip 32 of the upper wall 26 to the lower wall 28. The lower wall 28 may have a concave form or a is planar form. The bowl-shaped portion 20 may be generally conical or any other generally bowl shape.

Figure 5:
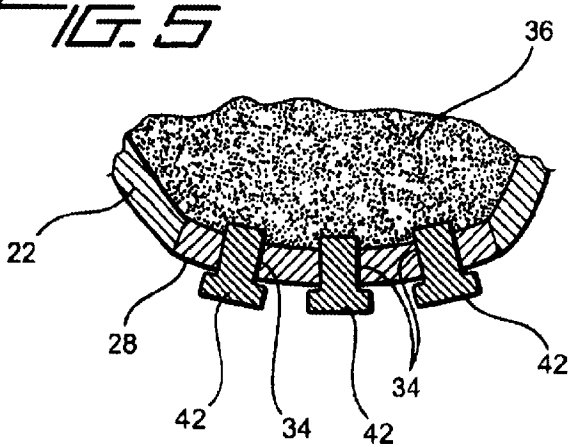
FIG. 5 is a cross-sectional view of the dispenser shown in FIG. 4 taken along the line 5—5.

The upper wall 26 may include one or more supply openings 34 which are used to fill the interior of the dispenser 10 with an appropriate powder or liquid dispensing agent 36 (see FIG. 5). The supply opening(s) 34 may then be closed, for example by means of an adhesive tape-like covering member 38 (shown in broken lines in FIG. 6) which is adhered to the outer surface of the upper wall 22 to close off the supply opening 34. The adhesive covering 38 can be removable to refill the dispenser 10, as desired. Other covering members which either permanently or removably cover the supply opening 34 can also be provided in the invention.

The lower wall 28 of the cartridge module 18 includes one or more dispensing openings 40 through which powder or liquid dispensing agent 36 in the cartridge module 18 is released. The number and size of dispensing opening(s) 40 may depend on the characteristics of the material being dispensed, for example, on the nature of the powder being dispensed, the nature and viscosity of the liquid being dispensed and/or the amount of powder or liquid which is to be dispensed at each operation of the dispenser 10. In an example wherein baby powder (baby talcum powder) is dispensed, for demonstration purposes, the dispensing opening(s) 40 may be about 1/32 to about 1/16 of an inch.

When in the rest position (i.e., not tapped) the powder in the cartridge module 18, forms a "bunched-up" seal at the dispensing opening(s) 40. When tapped, the "seal" (formed of bunched-up powder) is broken and a small amount of powder is dispensed under the influence of gravity until rest resumes (i.e, not tapped) and a "bunched-up" seal forms again at the opening(s) 40. Similar effects occur with liquid which has a sufficient viscosity to form a "seal" or meniscus at the opening(s) 40. Tapping or impact breaks the "seal", liquid is dispensed due to gravity, and a new "seal" is formed at the opening(s) 40 so that further liquid is not dispensed until the next tap or impact. If any small leakage of powder or liquid occurs between taps or impacts, no harm is done since only small amounts may be discharged.

With respect to the number of dispensing openings 40, in the embodiment shown in FIG. 2, there is only a single dispensing opening 40. In the embodiment shown in FIG. 3, there are two dispensing openings 40 while in the embodiment shown in FIG. 4, there are three dispensing openings 40. The dispensing opening(s) 40 may be situated in a lowermost part of the lower wall 28. When multiple dispensing openings 40 are provided, they may be appropriately spaced around the lower wall 28.

Figure 6:
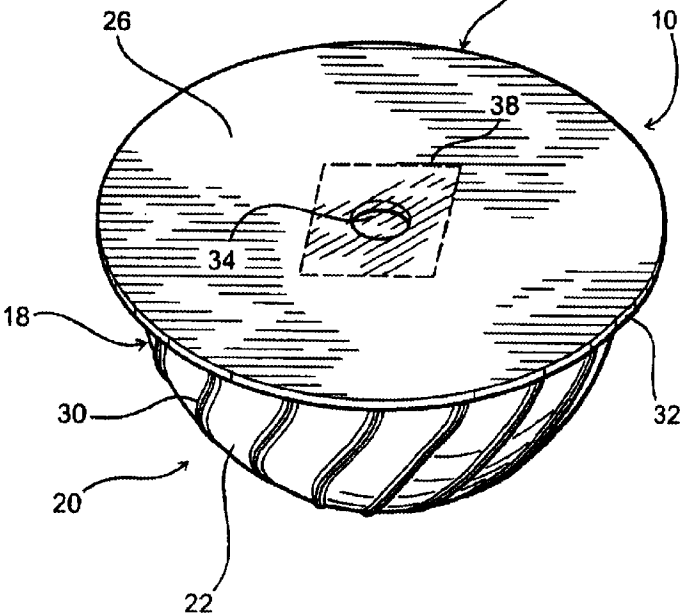
FIG. 6 is a perspective top view of the dispenser in accordance with the invention.

For shipping purposes, the dispensing opening(s) 40 is/are closed by plug members 42 as shown in FIG. 6. For use, one or more of the plug members 42 is pulled out by the user to enable the powder or liquid dispensing agent 36 to be dispensed from the dispenser 10 in the manner described below. Peel off tape may be used instead of plugs 42 to close the opening(s) 40.

FIG. 5 shows the dispenser 10 containing a powder dispensing agent 36 up to a level "L" (represented by the dotted line). This level "L" can be changed, depending upon how much dispensing agent 36 is desired to be put into the dispenser 10 and/or the nature of the dispensing agent 36 and/or other considerations.

In a preferred embodiment, the cartridge module 18 of the dispenser 10 is blow-molded, injection-molded or vacuum formed from a plastic material, preferably a transparent plastic material so that the contents thereof can be easily seen. Any inert material, such as FDA approved plastic materials, could be used. For example, polyurethane plastic material or other plastic materials which are capable of being blow-molded or injection-molded or vacuum formed, can be used. Also, materials from which, for example, plastic soda and other soft drink bottle are made, could be used.

In use, the dispenser 10, containing an appropriate amount of dispensing agent 36, is adhered or otherwise secured to the inner surface of a lid 14 of a trash disposal can 12, diaper pail or other waste disposal can. The disposal can 12 or the like is opened by opening the upper lid 14 in the normal manner for disposal of waste products. Then, the lid 14 is closed either manually, automatically, or by releasing a foot pedal 44 connected to the base 16 (see FIG. 1). When the lid 14 impacts the base 16 of the disposal can 12 during closing, this impact is sufficient to dispense a small amount of powder or liquid dispensing agent 36 from the dispenser 10 (alone or together with the force of gravity exerted on the dispensing agent 36). When the dispenser 10 is optimally placed above the waste insertion opening defined by the base 16, a small amount of the dispensing agent 36 is shaken and caused to fall through the dispensing opening(s) 40 into the waste insertion opening.

If a deodorizer powder is present in the dispenser 10, the deodorizer will act to deodorize the waste materials in the disposal can 12. If a powder disinfectant or material to kill viral and/or bacterial contaminants is present in the dispenser 10, a sufficient amount is dispensed by the impact to produce the desired result.

The amount of powder or liquid dispensing agent 36 dispensed at each closing operation of the lid 14 can be varied by varying the dispenser opening(s) 40 in the lower wall 28 of the cartridge module 18, or by varying the force or amount of impact. If sufficient dispensing agent 36 is not dispensed when the lid 14 of the disposal can 12 impacts the base 16 of the disposal can 12, additional dispensing agent 36 can be dispensed merely by the user tapping or impacting on the top or other parts of the disposal can 12, i.e., on the top of lid 14. In the alternative, an impact against the side of the disposal can 12 should also suffice to jar a small amount of the dispensing agent 36 to fall through the dispensing opening(s) 40. Such hand-tapping or tapping with an implement is sufficient to release additional dispensing agent to produce the desired effect.

When the quantity of dispensing agent 36 in the dispenser 10 is exhausted, the dispenser 10 can be removed from the lid 14 of the disposal can 12. If the dispenser 10 is a single-use dispenser 10, then the dispenser 10 is discarded and a new dispenser is installed, i.e., by removing the adhesive from the new dispenser 10 and adhering the new dispenser in the same location as the discarded dispenser 10. If the dispenser 10 is designed for multiple uses, the dispenser 10 is refilled with dispensing agent 36 through the supply opening(s) 34 and then reattached to the lid 14.

Although the dispenser 10 is shown mounted onto the lid 14 in the embodiment in FIG. 1, it is also possible to mount the dispenser 10 apart from the lid 14 yet above the base 16. For example, the dispenser 10 can be mounted to a cantilevered structure connected to the lid and/or base 16. The cantilevered structure would extend over the waste insertion opening defined by the base 16 and position the dispenser 10 over this opening. Closure of the lid 14 against the base 16 would sandwich the cantilevered structure with the dispenser 10 thereon causing shaking of the dispenser 10 and dispensing of the dispensing agent 36 therein through the dispensing opening(s) 40.

Figure 7:
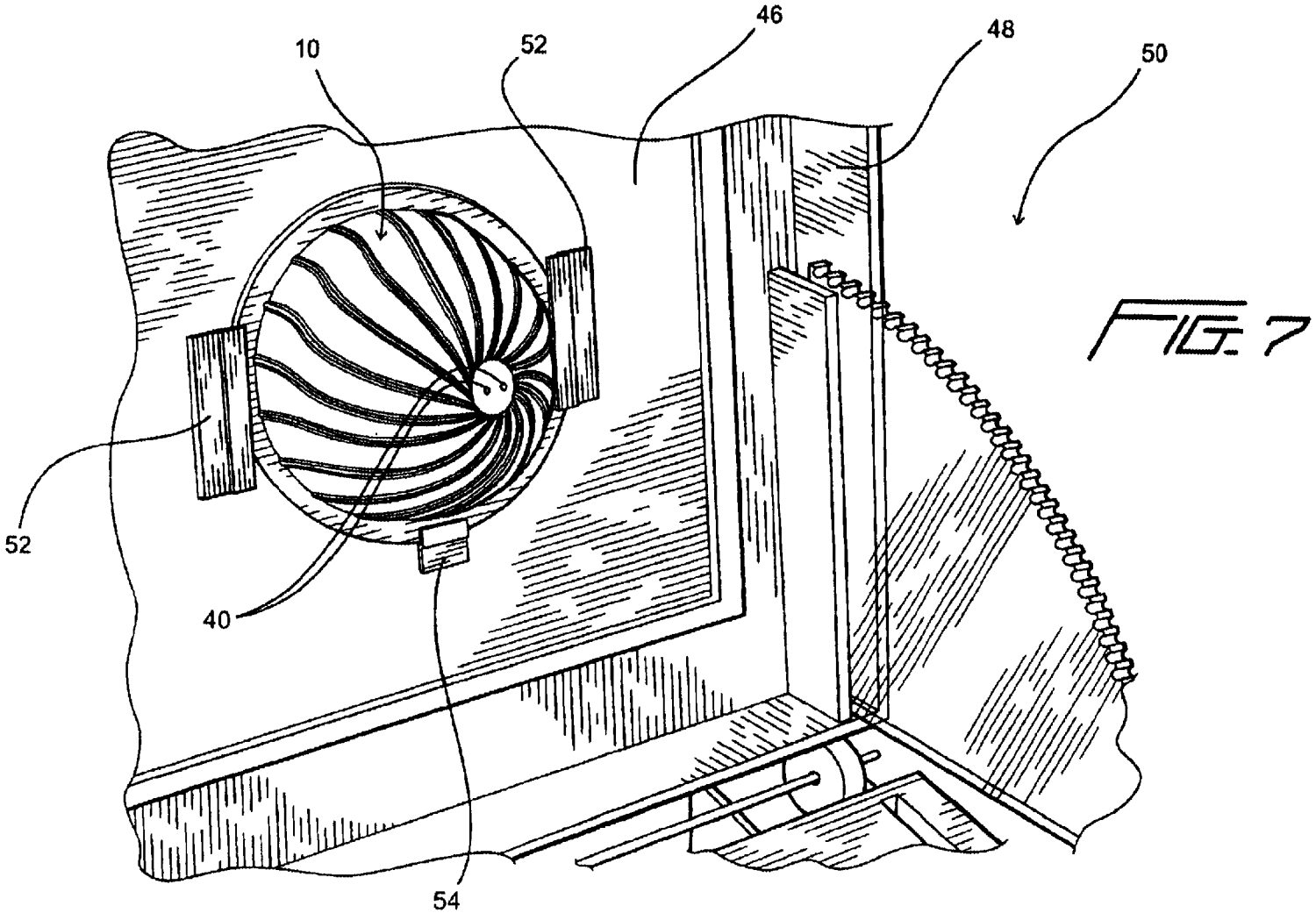
FIG. 7 shows part of a diaper pail in an open position with a lid having a powder dispenser of the present invention mounted onto an inner surface of the lid.
Figure 8:
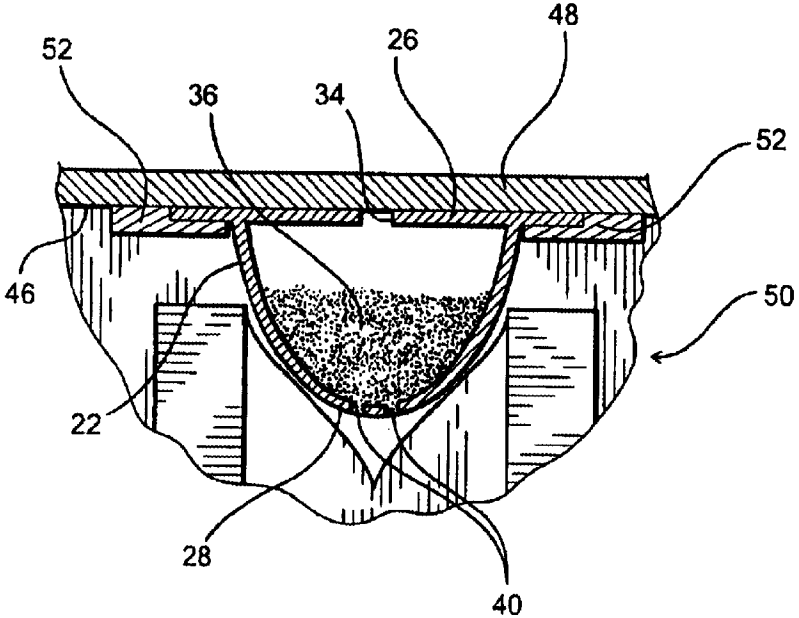
FIG. 8 is a cross-sectional view taken along the line 8—8 of FIG. 7.

FIGS. 7 and 8 show another embodiment of the use of the dispenser 10 of the invention. In this embodiment, the dispenser 10 is removably mounted to the inside surface 46 of a pivotable lid 48 of a diaper pail 50 (only part of which is shown). While the explanation of this embodiment is made with reference to a diaper pail, any other type of waste disposal pail, such as a garbage pail, medical or hazardous waste pail, etc. could be used.

To removably mount the dispenser 10 to the lid 48, retaining members 52, 54 are arranged on the inside surface 46 of the lid 48. Retaining members 52 are arranged opposite one another while retaining member 54 is arranged between retaining members 52 to form a three-point support for the dispenser 10. Each retaining member 52, 54 includes a step-like inner surface defining a receiving lip 56 onto which the lip 32 of the cartridge module 18 slides (see FIG. 8). Sufficient friction can be provided by proper dimensioning of the retaining members 52, 54 to retain the dispenser 10 in position.

The arrangement of the retaining members 52, 54 on three sides of the dispenser 10 enables the dispenser 10 to be slid in and out of engagement with the lid 48. As such, the diaper pail 50 can be sold with a separate dispenser 10 which is slid into engagement with the lid 48 before the first use of the diaper pail 50 and then removed when the powder or liquid in the dispenser 10 is exhausted. Then, either the empty dispenser 10 is refilled or a new dispenser 10 is obtained and slid into engagement with the lid 48.

In the embodiment shown in FIGS. 7 and 8, the impact of the lid 48 against the body or base of the diaper pail 50, which occurs upon closure of the lid 48 by the user after insertion of a waste item (soiled diaper) into the body of the diaper pail, can be sufficient to dispense a small amount of powder or liquid dispensing agent from the dispenser 10 into the body of the diaper pail where the waste items are retained. If it is desired to dispense additional powder or liquid, the user can merely tap on the lid 48 to cause the additional powder or liquid to be released from the dispenser 10 through the dispenser opening(s) 40 of the dispenser 10.

Figure 9:
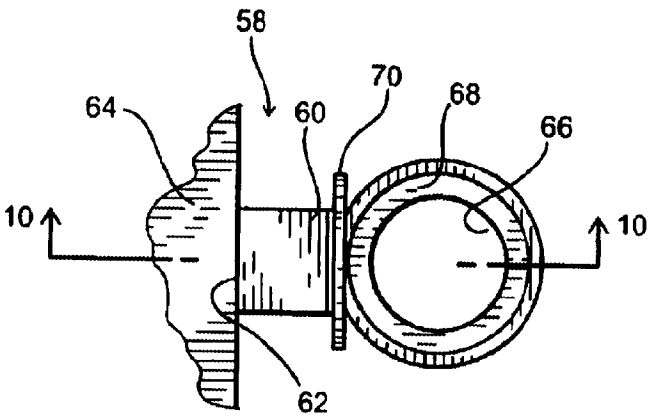
FIG. 9 is a top view of a wall-mounted dispensing unit capable of receiving a dispenser in accordance with the invention (shown without the dispenser).
Figure 10:
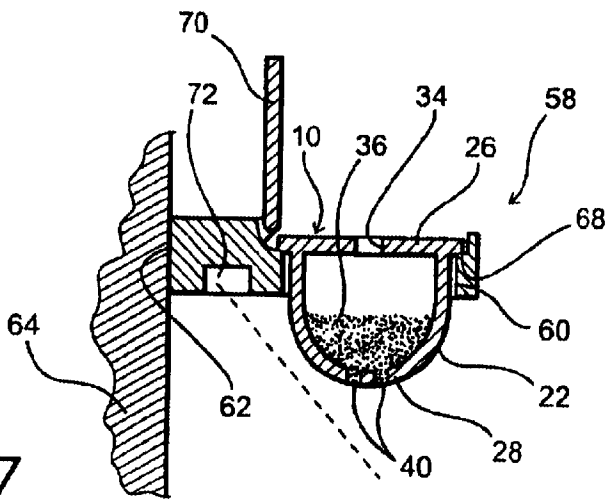
FIG. 10 is a cross-sectional view of the dispensing unit shown in FIG. 9 taken along the line 10—10 with a dispenser present.

The dispenser of the present invention can also be used to dispense powder or liquid from a wall-mounted device 58, such as shown in FIGS. 9 and 10. The wall-mounted device 58 includes a housing 60 having a vertically oriented surface 62 capable of being attached to a wall or other vertical surface 64, for example, by adhesive, screws, nails and Velcro(TM). Housing 60 includes an opening 66 into which the dispenser 10 is inserted facing in a downward direction. The dispenser 60 rests on an internal ledge 68 formed on the housing 60 and which surrounds the opening 66.

The wall-mounted device 58 also includes an operating or impact member 70 which imparts a jarring motion to the housing 60 or directly to the dispenser 10 when held by the housing 10 to cause a quantity of the dispensing agent 36 in the dispenser 10 to fall through the dispenser opening(s) 40. The impact member 70 may be a lid pivotally mounted to the housing 60 and, when pivoted by a user against the dispenser 10, it causes a jarring impact to be produced on the upper wall 26 of the dispenser 10 thereby causing powder or liquid to be dispensed from the dispensing opening(s) 40 at the bottom of dispenser 10. The impact member 70 may also be mounted separate from the housing 60, e.g., mounted to the wall 64, but designed to impact the upper wall 26 of the dispenser 10.

Alternatively, a motion sensor 72 can be arranged in the housing 60 to detect motion (in the direction of the dotted line), for example of a hand below the dispensing opening(s) 40 of the dispenser 10, so that an impact will be automatically produced to dispense powder or liquid dispensing agent 36 from the dispenser 10 through the dispenser opening(s) 40. The motion sensor 72 would thus be coupled to a mechanical device which causes the impact member 68 to fall against the upper wall 26 of the dispenser 10.

In the embodiments described above, the dispensing agent 36 is described as being a powder or liquid which is capable of falling through the dispensing opening(s) 40. Instead of a liquid or power dispensing agent, the cartridge module 18 may be used with a highly concentrated deodorizing block. This highly concentrated deodorizing module might not require the release of a powder, but may simply have one or more apertures which are opened enough so as to release the deodorizing material in gaseous form to neutralize the odor. However, release of powder or liquid appears to have a decided advantage, especially for arresting or neutralizing odorous smells, and minimizing or arresting bacterial and viral agents.

It is also possible that a timed-release device can be provided to release a measured amount of a dispensing agent, which serves as a deodorant or disinfectant, at timed intervals in certain applications where offensive odors or hazardous contaminants build up. In this case, a jarring impact might be simulated at the timed intervals to cause the release of the deodorant or disinfectant through the dispensing opening(s) 40.

The cartridge module 18 in any of the embodiments described herein can either be filled with the desired powder and sealed in a manufacturing plant and then the resultant dispenser 10 sold through many venues. This offers a huge replacement market for both the home, as well as the institutional market place. It is also possible that a dispenser unit (such as shown in FIGS. 9 and 10) can be given free with a six-pack of single-use dispensers 10, or a single, multi-use dispenser 10 with a quantity of additional dispensing agent. It is also possible to sell multi-packs of cartridge modules 18 without dispensing agent 36, or individual modules can also be sold separately for subsequent sales. In this case, by selling the cartridge modules 18 separately from the dispensing agent 36, the user can select from among a variety of different dispensing agents 36 which to put into the cartridge module, e.g., a disinfectant or a deodorant or a combination of both. Further, different size dispensers and dispensing units can be developed to cater to different markets. For example, a baby powder and diaper pail application might consist of a two-three ounce self-contained dispenser, which might last a month before replacing, while institutional dispensers might be twice, or three times that size due to increased traffic or use.

Although it is also possible to allow re-loading of powders or liquids into a special re-usable cartridge module 18 as discussed above, this may be less practical from a financial standpoint, unless one can provide replacement boxed powders and liquids that one can funnel into a re-useable cartridge module.

While the invention has been described above with respect to specific apparatus and specific implementations, it should be clear that various modifications and alterations can be made, and various features of one embodiment can be included in other embodiments, within the scope of the present invention.

I claim:

1. A dispenser, comprising:

a cartridge module having a lower wall portion and at least one side wall portion defining an interior, said lower wall portion defining a substantially horizontal support surface including at least one dispenser opening, said at least one side wall portion extending inwardly from an upper region thereof to said lower wall portion and being connected at a lower end region to an outer periphery of said lower wall portion; and a dispensing agent arranged in said interior of said cartridge module and being supported by said support surface of said lower wall portion and said at least one side wall portion, said dispensing agent being in a liquid or powder form to enable said dispensing agent to pass through said at least one dispenser opening in said lower wall portion.

2. The dispenser of claim 1, wherein said cartridge module further comprises an upper wall larger than said lower wall portion, said at least one side wall portion extending inward from said upper wall to said lower wall portion such that said dispensing agent moves alone said at least one side wall portion in a direction toward said lower wall portion.

3. The dispenser of claim 2, wherein said upper wall is circular and defines a circumferential lip which extends circumferentially outward beyond said at least one side wall portion.

4. The dispenser of claim 2, wherein said upper wall at least one supply opening therein through which said dispensing agent is insertable into said interior of said cartridge module while said upper wall is maintained in connection with said at least one side wall portion.

5. The dispenser of claim 4, further comprising a covering member for covering said at least one supply opening.

6. The dispenser of claim 5, wherein said covering member is a removable adhesive covering.

7. The dispenser of claim 1, wherein said at least one side wall portion includes indicia of a filling level of said dispensing agent.

8. The dispenser of claim 1, wherein said at least one side wall portion is transparent.

9. The dispenser of claim 1, wherein said at least one side wall portion is a single substantially hemispherical-shaped wall.

10. The dispenser of claim 1, wherein said cartridge module includes a reinforcing structure arranged in connection with said at least one side wall portion.

11. The dispenser of claim 1, wherein said lower wall portion is planar.

12. The dispenser of claim 1, wherein said lower wall portion is concave.

13. The dispenser of claim 1, wherein said at least one dispenser opening consists of a single dispenser opening.

14. The dispenser of claim 1, wherein said at least one dispenser opening consists of two dispenser openings.

15. The dispenser of claim 1, wherein said at least one dispenser opening consists of three dispenser openings.

16. The dispenser of claim 1, further comprising at least one removable plug for plugging a respective one of said at least one dispenser opening.

17. The dispenser of claim 1, wherein said cartridge module is unitary.

18. The dispenser of claim 1, wherein a size and a number of said at least one dispenser opening is selected based on one or more characteristics of said dispensing agent.

19. The dispenser of claim 1, further comprising at least one removable plug arranged to be inserted into a respective one of said at least one dispenser opening to close said respective dispenser opening.

20. The dispenser or claim 1, wherein said dispensing agent is a deodorizing or disinfecting agent.

21. A waste disposal can, comprising:

a base defining a waste-receiving receptacle and an opening leading to said receptacle;

a lid movably mounted to said base and having an open position in which said opening is accessible and a closed position in which said opening is covered; and a dispenser arranged between said base and said lid and at least partially above said opening, said dispenser including a powder or liquid dispensing agent and regulating means for regulating dispensing of said dispensing agent based on jarring of said dispenser, said regulating means comprising a support surface on which said dispensing agent is supported and at least one dispenser opening formed in said support surface through which a portion of said dispensing agent falls upon jarring of said dispenser caused by each movement of said lid to its closed position.

22. The waste disposal can of claim 21, wherein said dispenser includes a cartridge module having a lower wall portion and at least one side wall portion defining an interior said lower wall portion defining said support surface, said dispensing agent being arranged in said interior of said cartridge module.

23. The waste disposal can of claim 22, wherein said at least one side wall portion extends inwardly from an upper region thereof to said lower wall portion such that said dispensing agent moves along said at least one side wall portion in a direction toward said lower wall.

24. The waste disposal can of claim 22, wherein said at least one side wall portion is a single substantially hemispherical-shaped wall.

25. The waste disposal can of claim 22, wherein said cartridge module further includes an upper wall which defines a circumferential lip, said lid including retaining members formed on a lower surface and arranged to receive said lip of said dispenser to thereby mount said dispenser on said lower surface of said lid.

26. The waste disposal can of claim 25, wherein each of said retaining members includes a step-like inner surface defining a receiving lip onto which said lip of said dispenser slides.

27. The waste disposal can of claim 25, wherein said upper wall includes at least one supply opening through which said dispensing agent is insertable into said interior of said cartridge module.

28. The waste disposal can of claim 21, wherein said dispenser is mounted on a lower surface of said lid above said opening.

29. The waste disposal can of claim 24, further comprising connecting means for connecting said dispenser to said lid.

30. The waste disposal can of claim 29, wherein said connecting means comprise a removable adhesive.

31. The waste disposal can of claim 21, wherein said dispensing agent is a deodorizing or disinfecting agent.

32. A waste disposal can, comprising:

a base defining a waste-receiving receptacle and an opening leading to said receptacle;

a lid movably mounted to said base and having an open position in which said opening is accessible and a closed position in which said opening is covered; and a dispenser arranged between said base and said lid and at least partially above said opening said dispenser including a powder or liquid dispensing agent, at least one dispenser opening through which said dispensing agent falls upon movement of said lid to its closed position, and an upper wall defining a circumferential lip, said lid including at least one retaining member formed on a lower surface of said lid and arranged to receive said lip of said dispenser to thereby mount said dispenser on said lower surface of said lid, said at least one retaining member including a step-like inner surface defining a receiving lip onto which said lip of said dispenser slides.

* * * * *